US009964291B1

(12) United States Patent
Del Rio

(10) Patent No.: US 9,964,291 B1
(45) Date of Patent: May 8, 2018

(54) HOLIDAY LIGHT STRING HANGING DEVICE

(71) Applicant: Rene Del Rio, Orlando, FL (US)

(72) Inventor: Rene Del Rio, Orlando, FL (US)

( * ) Notice: Subject to any disclaimer, the term of this patent is extended or adjusted under 35 U.S.C. 154(b) by 0 days. days.

(21) Appl. No.: 15/444,194

(22) Filed: Feb. 27, 2017

(51) Int. Cl.
*F21V 21/00* (2006.01)
*F21V 21/096* (2006.01)
*F21S 4/10* (2016.01)
*F21W 121/00* (2006.01)

(52) U.S. Cl.
CPC ..... *F21V 21/096* (2013.01); *F21S 4/10* (2016.01); *F21W 2121/00* (2013.01)

(58) Field of Classification Search
CPC ..... F21V 21/096; F21S 4/00; F21W 2121/00
See application file for complete search history.

(56) References Cited

U.S. PATENT DOCUMENTS 5,873,651 A * 2/1999 Hofer ..... F21V 19/0005 362/396
2009/0185370 A1* 7/2009 Moore ..... F21V 21/088 362/219
2012/0069587 A1* 3/2012 Holland ..... F21V 21/088 362/396
2012/0218759 A1* 8/2012 Cooper ..... F16B 2/245 362/249.01
2012/0300439 A1* 11/2012 Davis Hatfield ..... B62B 9/005 362/183
2013/0294056 A1* 11/2013 Eibner ..... F21L 4/00 362/184

* cited by examiner

*Primary Examiner* — Ali Alavi
(74) *Attorney, Agent, or Firm* — Gulf Coast Intellectual Property Group

(57) ABSTRACT

A holiday light hanging device that is operable to releasably secure a holiday light string and/or a holiday light to a support structure such as but not limited to a roof eave. The holiday light hanging device includes a body wherein the body is formed utilizing a first support member, a second support member and a third support member. The body further includes a receiving member that is contiguously formed with the third support member wherein the receiving member is ring-shaped and is configured to receive a portion of a holiday light string and/or a holiday light. A magnet is further provided wherein the magnet is secured within a housing that is integrally formed into the first support member. A slot and lip are formed on the receiving member so as to facilitate the placement of a portion of a holiday light string in the void.

20 Claims, 1 Drawing Sheet

HOLIDAY LIGHT STRING HANGING DEVICE

FIELD OF INVENTION

The present invention relates generally to lighting, more specifically but not by way of limitation, a holiday light hanging device that is configured to suspend a holiday light or holiday light string wherein the holiday light hanging device utilizes magnets to releasably secure to a suitable support surface.

BACKGROUND

As is known in the art, holiday lights are utilized by millions of homeowners as a means of celebrating a particular holiday such as but not limited to Christmas. Holiday lights are available in many styles and forms but one common style is a holiday light string. Conventional holiday light strings are typically many feet in length and function to electrically couple a plurality of lights in order to be suspended from a desired object such as but not limited to a roof edge and/or roof eave. Homeowners have utilized numerous types of conventional fasteners in order to successfully suspend holiday lights strings along roof edges and/or roof eaves.

One issue with conventional fasteners is the utilization thereof can cause damage to the support surface. Brackets, nails, screws and the like that are utilized to suspend holiday lights leave undesirable markings and/or holes in the support surface. Users of these conventional devices typically prefer to remove them after the holiday celebration as the remaining fasteners create an undesirable appearance. Additionally, the installation and removal of these conventional fasteners is cumbersome and time consuming. Other devices such as but not limited to roof clips are manufactured from plastic and have shown to degrade over time and have reduced holding capabilities.

Accordingly, there is a need for a holiday light string hanging device that is configured to be quickly secured and removed to a suitable support surface wherein the holiday light string hanging device further provides secure fastening so as to effectively maintain the position of the holiday light strings during high winds, storms and other adverse conditions.

SUMMARY OF THE INVENTION

It is the object of the present invention to provide a holiday light string hanging device that is configured to releasably secure to a suitable support surface that includes a body wherein the body includes a plurality of integrally formed support members.

Another object of the present invention is to provide a holiday light string hanging device that is operable to suspend a holiday light string to a roof eave or other suitable support surface wherein the plurality of integrally formed support members includes a first support member.

A further object of the present invention is to provide a holiday light string hanging device that is operable to suspend a holiday light string to a roof eave or alternate suitable support surface wherein the first support member includes at least one magnet formed therein.

Still another object of the present invention is to provide a holiday light hanging device configured to releasably secure a holiday light string to a roof eave wherein the plurality of integrally formed support members further includes a second support member wherein the second support member is perpendicular to the first support member extending outward therefrom.

An additional object of the present invention is to provide a holiday light hanging device that is operable to releasably secure a holiday light string to a suitable support surface wherein the plurality of integrally formed support members further include a third support member with the third support member being contiguous with the second support member extending downward therefrom.

Yet a further object of the present invention is to provide a holiday light hanging device that is configured to utilize magnets to releasably secure the holiday light hanging device to a suitable support structure that further includes a receiving member wherein the receiving member is annular in shape and is contiguous with the third support member distal to the second support member.

Another object of the present invention is to provide a holiday light string hanging device that is operable to releasably secure holiday lights and/or holiday light strings wherein the receiving member further includes a lip extending outward therefrom.

An alternate object of the present invention is to provide a holiday light string hanging device that is configured to releasably secure holiday light strings to a roof eave wherein the holiday light string hanging device is provided in alternate sizes.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
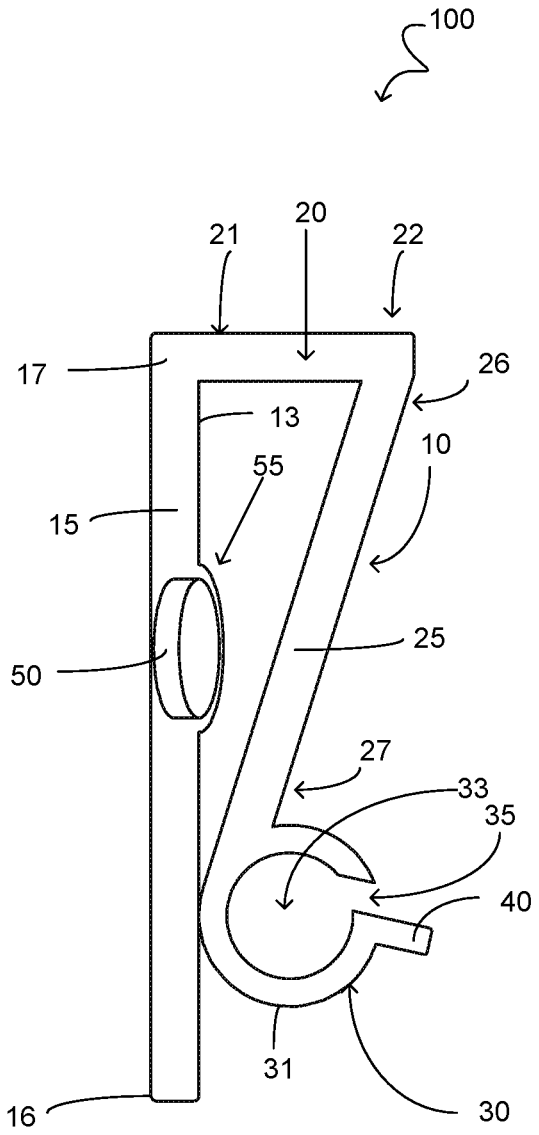
FIG. 1 is a side view of the present invention.
Figure 2:
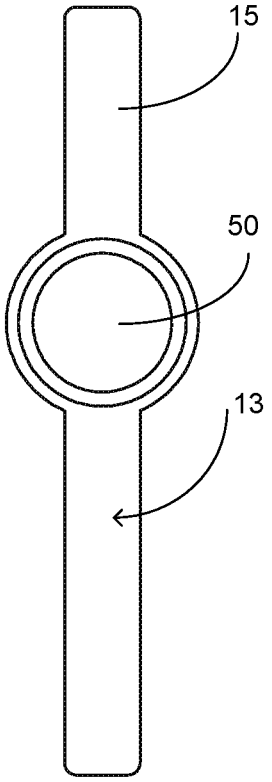
FIG. 2 is a rear view of the present invention.

Referring now to the drawings submitted herewith, wherein various elements depicted therein are not necessarily drawn to scale and wherein through the views and figures like elements are referenced with identical reference numerals, there is illustrated a holiday light hanging device 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to FIG. 1 herein, the holiday light hanging device 100 further includes a body 10. The body 10 is manufactured from a durable material such as but not limited to plastic. The body 10 includes a first support member 15. The first support member 15 is rectangular in shape having a first end 16 and second end 17. The first support member 15 includes rear surface 13 that is flat in manner and is configured to be placed adjacent to a suitable mounting surface such as but not limited to a roof eave. While no particular length of the first support member is required, good results have been achieved utilizing a first support member 15 that is one and five-eighths inches in length. Furthermore, while no particular thickness of the first support member 15 is required, good results have been achieved utilizing a first support member 15 that is one-eighth inch thick so as to provide desirable rigidity and structure.

Integrally formed into the first support member 15 is housing 55. Housing 55 is annular in shape and is configured to have secured therein a magnet 50. Magnet 50 is a conventional magnet that is secured within the housing 55 utilizing suitable durable techniques such as but not limited to chemical adhesion. The magnet 50 is operable to releasably secure the holiday light hanging device 100 to a suitable metal surface such as but not limited to a roof eave. While the first support member 15 is illustrated herein as having one magnet 50 secured in housing 55, it is contemplated within the scope of the present invention that the first support member 15 could have more than one magnet 50 in order to adjust the retention force of the holiday light hanging device 100. It is further contemplated within the scope of the present invention that the magnet 50 could be provided in alternate sizes.

Integrally secured to the first support member 15 is the second support member 20. The second support member 20 is contiguous with the second end 17 of the first support member 15. The second support member 20 includes a first end 21 and second end 22 and is perpendicular to the first support member 15 extending outward therefrom. Contiguously secured to the second end 22 of the second support member 20 is the third support member 25. The third support member 25 is contiguous with the second end 22 of the second support member 20 and is configured to extend downward therefrom. The third support member 25 includes first end 26 and second end 27. The third support member 25 is configured so as to be angularly oriented with respect to the first support member 15 wherein the second end 27 is proximate the first support member 15. The angular configuration of the third support member 25 provides structural strength desired for maintaining a holiday light and/or holiday light string.

Integrally formed with the third support member 25 proximate second end 27 is a receiving member 30. The receiving member 30 is configured to receive a portion of a cord or other structure of a holiday light and/or holiday light string and releasably secure thereto. The receiving member 30 is ring shaped being formed from a single curved member wall 31. The receiving member 30 includes void 33 that is of suitable size so as to receive either a portion of a cord of a holiday light string or a portion of a holiday light. The receiving member 30 includes slot 35 wherein slot 35 provides access to void 33 allowing a user to journal a portion of a holiday light string therethrough so as to be releasably secured within the void 33. It is contemplated within the scope of the present invention that the void 33 and slot 35 could be manufactured in various sizes in order to accommodate a portion of a holiday light string and/or holiday light that is to be suspended.

Contiguously formed with the receiving member 30 is lip 40. Lip 40 is formed beneath the slot 35 and extends outward from receiving member 30. The lip 40 functions to assist a user in loading either a portion of a holiday light string and/or a portion of a holiday light into the receiving member 30 wherein the lip 40 functions to guide the aforementioned into the slot 35 and subsequently into the void 33. The lip 40 is oriented in a downward angle so as to accomplish the aforementioned. While no particular angle is required, good results have been achieved utilizing an angle of approximately ninety-two degrees with respect to the inner longitudinal edge 13 of the first support member 15.

While the body 10 of the holiday light hanging device 100 has been disclosed herein being comprised of a first support member 15, second support member 20 and third support member 25 contiguously formed it is contemplated within the scope of the present invention that body 10 could be formed utilizing alternate quantities of support members and still achieve the desired functionality as described herein.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A holiday light hanging apparatus configured to support a holiday light or holiday light string for display comprising:

a body, said body having a plurality of support members, wherein at least one of said plurality of support members is configured to be releasably secured adjacent a support structure so as to be parallel thereto and wherein at least one of said plurality of support members is perpendicular to the one of said plurality of support members configured to be adjacent a support structure;

a receiving member, said receiving member being contiguously formed with said body, said receiving member being ring-shaped, said receiving member further having a void configured to receive a portion of a holiday light or a portion of a holiday light string; and wherein the body further includes at least one magnet, said at least one magnet being secured to the one of said plurality of support members configured to be releasably secured to a support structure.

2. The holiday light hanging apparatus as recited in claim 1, wherein said receiving member further includes a slot, said slot operable to provide access to said void.

3. The holiday light hanging apparatus as recited in claim 2, and further including a lip, said lip being contiguously formed with said receiving member, said lip being adjacent said slot, said lip extending outward from said receiving member.

4. The holiday light hanging apparatus as recited in claim 3, wherein said body further includes a housing, said housing being integrally formed with the one of said plurality of support members configured to be releasably secured to a support structure, said housing configured to secure the at least one magnet.

5. The holiday light hanging apparatus as recited in claim 4, wherein said lip is angularly positioned with respect to the one of said plurality of support members configured to be releasably secured to a support structure such that said lip is approximately 92 degrees with respect thereto.

6. The holiday light hanging apparatus as recited in claim 5, wherein the at least one magnet is annular in shape.

7. The holiday light hanging apparatus as recited in claim 6, wherein said body is manufactured from plastic.

8. A holiday light hanging device that is operable to suspend a holiday light or a holiday light string to a structure for display thereof comprising:

a body, said body being formed from a first support member, a second support member and a third support member, said body being triangular in shape, said first support member being configured to be place adjacent to and parallel with a portion of the structure, said second support member being contiguously formed with said first support member, said second support member being perpendicular to said first support member and extending outward therefrom, said third support member being integrally formed with said second support member distal to said first support member;

a receiving member, said receiving member being contiguously formed with said third support member distal to said second support member, said receiving member configured to receive and retain a portion of a holiday light or a portion of a holiday light string; and at least one magnet, said at least one magnet being secured in said first support member, said at least one magnet operable to releasably secure the holiday light hanging device to the structure.

9. The holiday light hanging device as recited in claim 8, wherein said receiving member is ring-shaped, said receiving member further including a void, said void configured to receive and retain a portion of a holiday light or a portion of a holiday light string.

10. The holiday light hanging device as recited in claim 9, wherein said receiving member further includes slot, said slot configured to provide access to said void.

11. The holiday light hanging device as recited in claim 10, and further including a lip, said lip being formed with said receiving member, said lip being adjacent said slot, said lip being beneath said slot, said lip extending outward from said receiving member.

12. The holiday light hanging device as recited in claim 11, and further including a housing, said housing being formed in said first support member, said housing configured to retain the magnet.

13. The holiday light hanging device as recited in claim 12, wherein said third support member is angular in manner with respect to said first support member.

14. The holiday light hanging device as recited in claim 13, wherein said lip is positioned at an angle relative to the first support member wherein the lip is 92 degrees with respect thereto.

15. A holiday light hanging device that is operable to suspend a holiday light or a holiday light string to a structure for display thereof comprising:

a body, said body being formed from a first support member, a second support member and a third support member, said body being triangular in shape, said first support member being configured to be place adjacent to and parallel with a portion of the structure, said first support member having a first end and a second end, said second support member being contiguously formed with said first support member, said second support member having a first end and a second end, said second support member being perpendicular to said first support member and extending outward therefrom, said third support member being integrally formed with said second support member distal to said first support member, said third support member having a first end and a second end;

a receiving member, said receiving member being contiguously formed with said third support member proximate said second end of said third support member distal to said second support member, said receiving member configured to receive and retain a portion of a holiday light or a portion of a holiday light string; and a magnet, said magnet being secured in said first support member, said magnet operable to releasably secure the holiday light hanging device to the structure.

16. The holiday light hanging device as recited in claim 15, wherein said receiving member is ring-shaped being formed from a curved member wall, said receiving member having a void.

17. The holiday light hanging device as recited in claim 16, wherein said curved member wall of said receiving member further includes a slot, said slot configured to provide access to said void for receiving a portion of a holiday light or holiday light string.

18. The holiday light hanging device as recited in claim 17, and further including a lip, said lip being integrally formed with said curved member wall of said receiving member, said lip located beneath said slot, said lip extending outward from said curved member wall.

19. The holiday light hanging device as recited in claim 18, wherein said lip extends outward from said curved member wall at an angle relative to the first support member wherein the lip is 92 degrees with respect to the first support member.

20. The holiday light hanging device as recited in claim 19, and further including a housing, said housing being formed in said first support member, said housing configured to retain the magnet.

* * * * *